US011229569B2

(12) United States Patent
Edouart-Sorensen

(10) Patent No.: US 11,229,569 B2
(45) Date of Patent: Jan. 25, 2022

(54) LIFTING BELT ASSEMBLY

(71) Applicant: Aleta Edouart-Sorensen, Port Angeles, WA (US)

(72) Inventor: Aleta Edouart-Sorensen, Port Angeles, WA (US)

( * ) Notice: Subject to any disclaimer, the term of this patent is extended or adjusted under 35 U.S.C. 154(b) by 15 days.

(21) Appl. No.: 16/834,734

(22) Filed: Mar. 30, 2020

(65) Prior Publication Data

US 2021/0298975 A1 Sep. 30, 2021

(51) Int. Cl.
*A61G 7/10* (2006.01)
*A61G 7/14* (2006.01)

(52) U.S. Cl.
CPC ..... *A61G 7/1023* (2013.01); *A61G 2200/34* (2013.01); *A61G 2200/50* (2013.01)

(58) Field of Classification Search
CPC .. A61G 7/1023; A61G 7/1013; A61G 7/1051; A61G 7/1049
USPC ..... 5/81.1 T, 89.1, 81.1 R, 925, 926
See application file for complete search history.

(56) References Cited

U.S. PATENT DOCUMENTS 4,944,057 A 7/1990 Shaw
5,214,813 A * 6/1993 Gastle ..... A61G 1/01 5/625
5,333,335 A * 8/1994 Gastle ..... A61G 1/01 5/625
D366,550 S 1/1996 Shapiro
6,671,899 B1 1/2004 Oja
7,669,264 B1 * 3/2010 Moses ..... A61G 7/1023 5/628
7,926,860 B2 4/2011 Hill
8,701,225 B1 * 4/2014 Latiff ..... A61G 7/1073 5/81.1 T
10,363,188 B2 7/2019 Young
11,020,301 B2 * 6/2021 Messerschmidt .... A61G 7/1023
2002/0026667 A1 3/2002 Berry
2017/0181910 A1 6/2017 Petterson
2019/0091084 A1 * 3/2019 Messerschmidt .... A61G 7/1026

FOREIGN PATENT DOCUMENTS

WO WO2015142845 9/2015

* cited by examiner

*Primary Examiner* — Robert G Santos

(57) ABSTRACT

A lifting belt assembly for lifting or repositioning a non-ambulatory person includes a belt that is slidable behind or beneath a non-ambulatory person that needs to be moved or repositioned. The belt is comprised of a friction inhibiting material to enhance sliding the belt behind or beneath the non-ambulatory person. The belt has a pair of gripping holes each extending therethrough to facilitate a caregiver to grip the belt for lifting or repositioning the non-ambulatory person. A set of first pads is each coupled to the belt and each of the first pads is aligned with a respective one of the gripping holes. A set of second pads is each coupled to the belt and each of the second pads is aligned with a respective one of the gripping holes.

6 Claims, 3 Drawing Sheets

LIFTING BELT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to lifting devices and more particularly pertains to a new lifting device for lifting or repositioning a non-ambulatory person.

(2) Description of Related Art Including Information Disclosed Under 37 CFR 1.97 and 1.98

The prior art relates to lifting devices and the prior art discloses a basket that is positionable beneath a person to facilitate a caregiver to lift the person in a seated position. The prior art discloses a lifting belt that includes a plurality of loops for securing a person to the lifting belt thereby facilitating a caregiver to assist the person with standing and moving. The prior art discloses a lifting strap that includes a pair of handles each being coupled to the lifting strap for assisting a user to lift an object from the ground. The prior art discloses a lifting panel that includes a mesh portion and a pair of handle straps being coupled thereto. The prior art also discloses a lifting strap that includes a widened portion for having a person sit thereon and a pair of handles at each end to facilitate a pair of caregivers to lift the person.

BRIEF SUMMARY OF THE INVENTION

An embodiment of the disclosure meets the needs presented above by generally comprising a belt that is slidable behind or beneath a non-ambulatory person that needs to be moved or repositioned. The belt is comprised of a friction inhibiting material to enhance sliding the belt behind or beneath the non-ambulatory person. The belt has a pair of gripping holes each extending therethrough to facilitate a caregiver to grip the belt for lifting or repositioning the non-ambulatory person. A set of first pads is each coupled to the belt and each of the first pads is aligned with a respective one of the gripping holes. A set of second pads is each coupled to the belt and each of the second pads is aligned with a respective one of the gripping holes.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
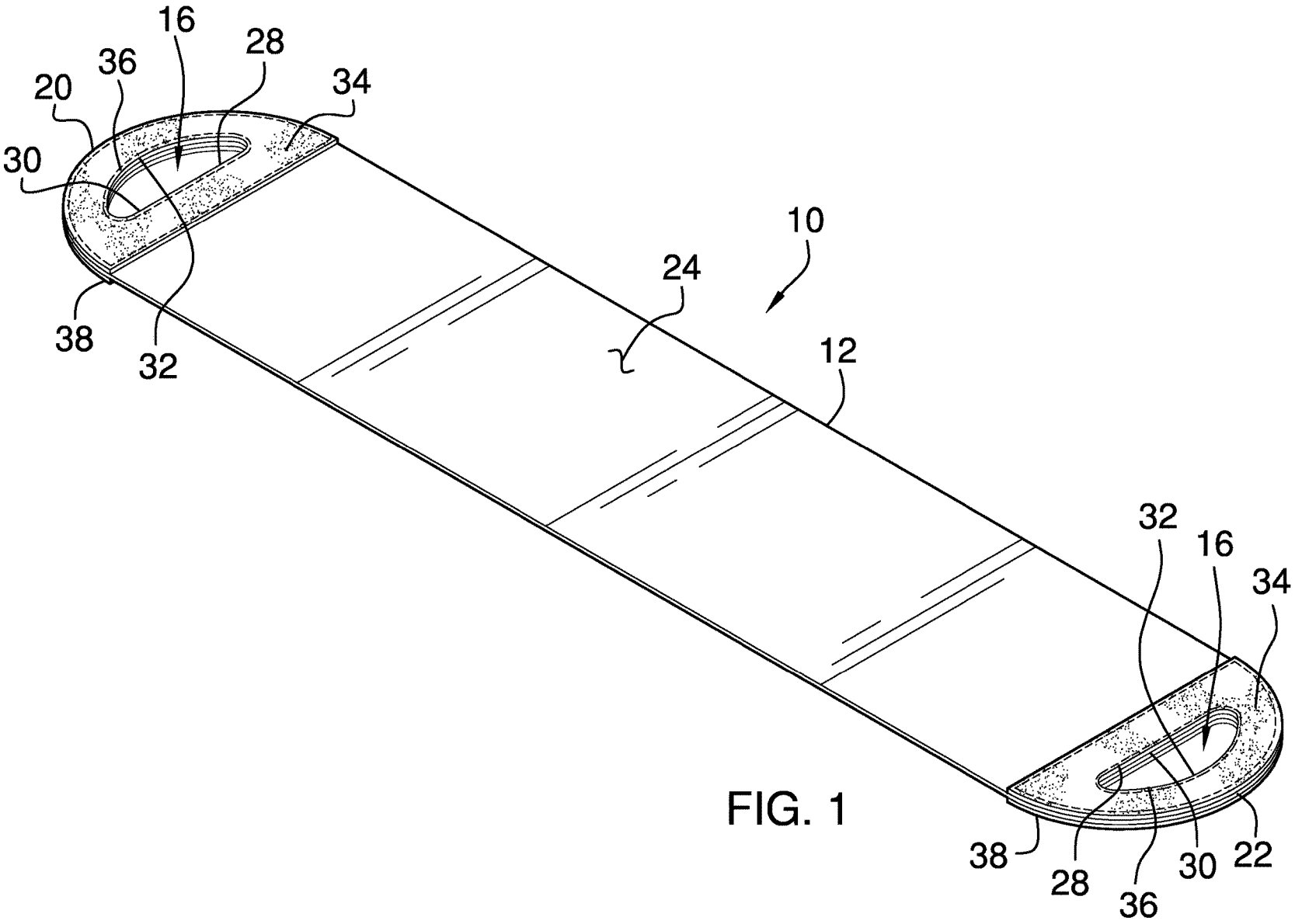
FIG. 1 is a top perspective view of a lifting belt assembly according to an embodiment of the disclosure.
Figure 2:
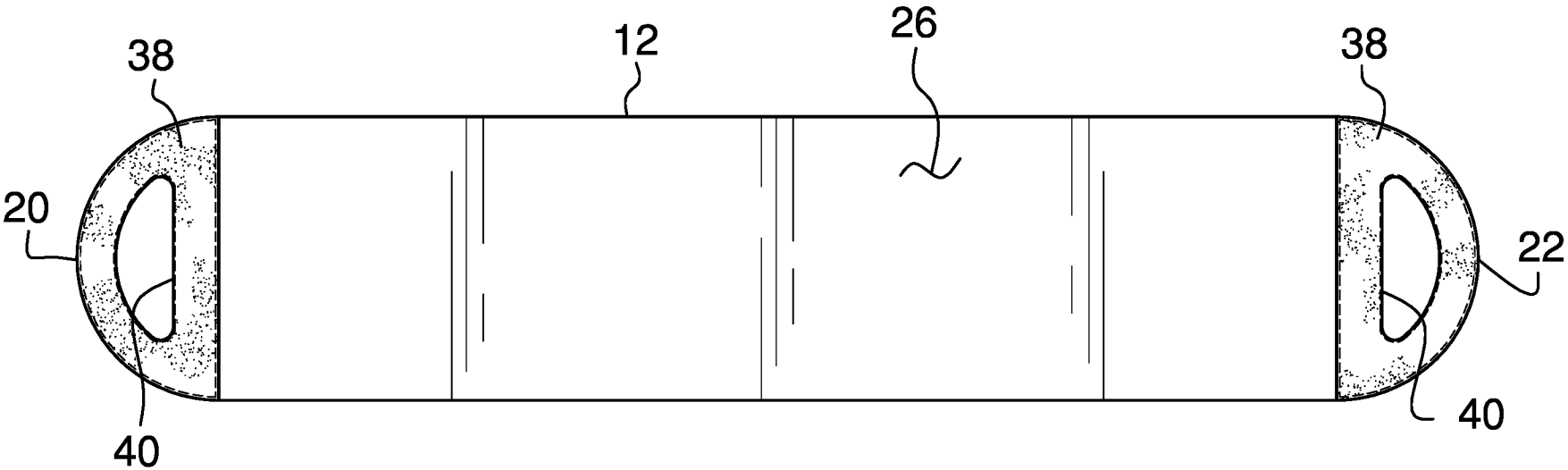
FIG. 2 is a bottom view of an embodiment of the disclosure.
Figure 3:
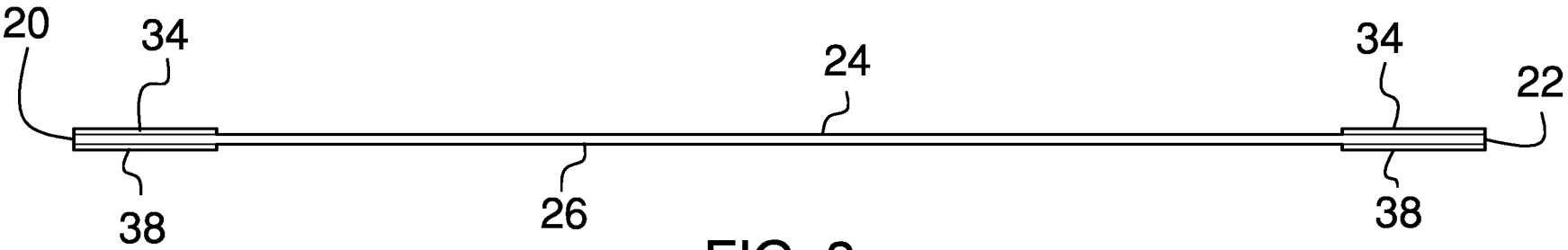
FIG. 3 is a front view of an embodiment of the disclosure.
Figure 4:
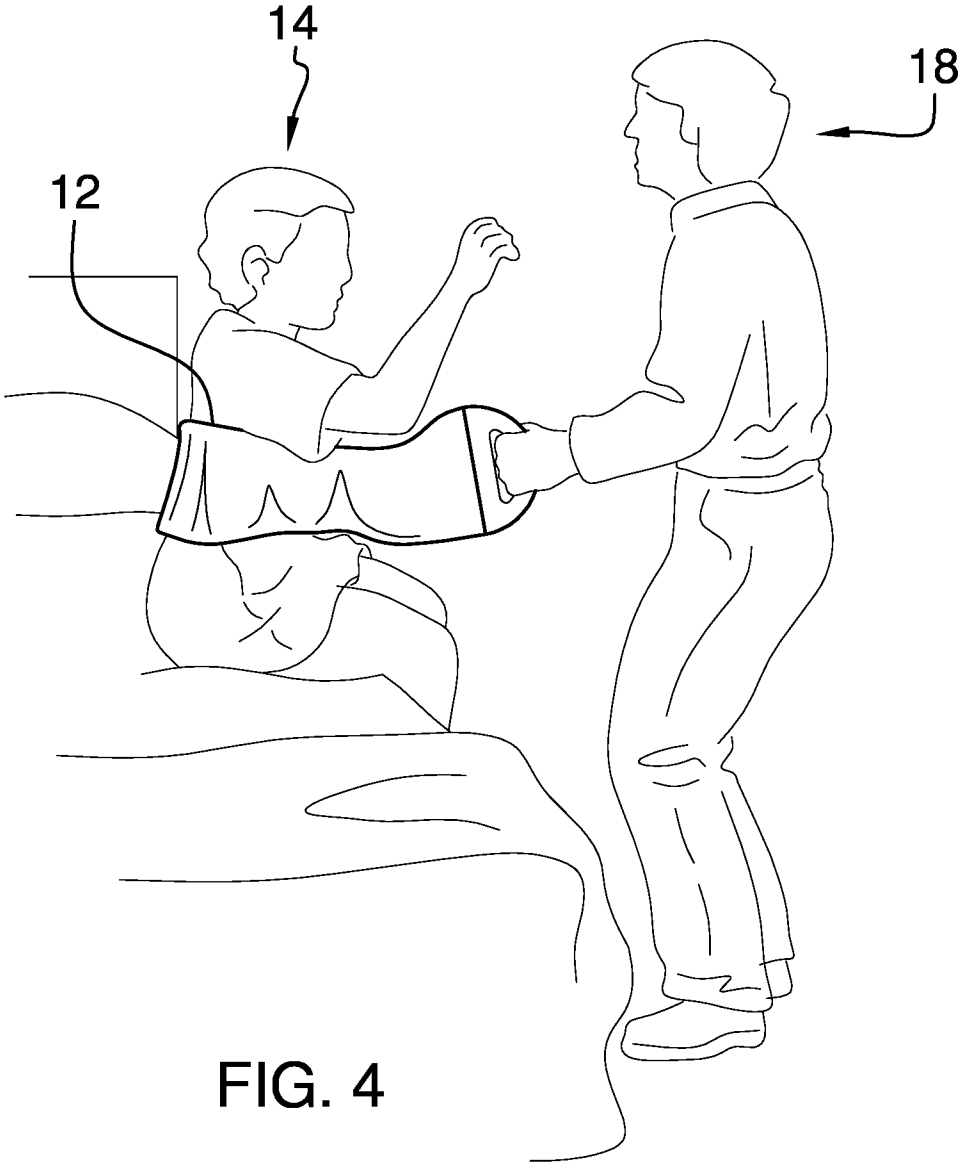
FIG. 4 is a perspective in-use view of an embodiment of the disclosure.

With reference now to the drawings, and in particular to FIGS. 1 through 4 thereof, a new lifting device embodying the principles and concepts of an embodiment of the disclosure and generally designated by the reference numeral 10 will be described.

As best illustrated in FIGS. 1 through 4, the lifting belt assembly 10 generally comprises a belt 12 that is slidable behind or beneath a non-ambulatory person 14 that needs to be moved or repositioned. The belt 12 is comprised of a friction inhibiting material to enhance sliding the belt 12 behind or beneath the non-ambulatory person 14. The belt 12 has a pair of gripping holes 16 each extending therethrough to facilitate a caregiver 18 to grip the belt 12 for lifting or repositioning the non-ambulatory person 14. In this way the caregiver 18 can gain a mechanical advantage over the weight of the non-ambulatory person 14 as well as to facilitate the caregiver 18 to employ beneficial posturing during the lifting. The belt 12 may have a length of at least 48.0 inches thereby facilitating the belt 12 to be fully wrapped around the non-ambulatory person 14. The non-ambulatory person 14 may be a physically disabled, elderly patient and the caregiver 18 may be a medical professional that is caring the for physically disabled, elderly patient.

The belt 12 has a first end 20, a second end 22, a front surface 24 and a back surface 26. The belt 12 is elongated between the first end 20 and the second end 22, and each of the first end 20 and the second end 22 is rounded. Each of the gripping holes 16 extending through the front surface 24 and the back surface 26, and each of the gripping holes 16 is positioned adjacent to a respective one of the first end 20 or the second end 22. Moreover, each of the gripping holes 16 has a bounding edge 28 and the bounding edge 28 of each of the gripping holes 16 has a first side 30 and a second side 32 is convexly arcuate with respect to the first side 30. The second side 32 of the bounding edge 28 of each of the gripping holes 16 is oriented to be co-arcuate with the respective first end 20 or second end 22 of the belt 12.

A set of first pads 34 is provided and each of the first pads 34 is coupled to the belt 12. Each of the first pads 34 is aligned with a respective one of the gripping holes 16 for gripping by the caregiver 18. Each of the first pads 34 is comprised of a resiliently compressible material to enhance comfort for the caregiver 18 and each of the first pads 34 is positioned on a respective one of the front surface 24 and the back surface 26 of the belt 12. Each of the first pads 34 has an opening 36 extending therethrough and the opening 36 in each of the first pads 34 is aligned with the respective gripping hole 16.

A set of second pads 38 is provided and each of the second pads 38 is coupled to the belt 12. Each of the second pads 38 is aligned with a respective one of the gripping holes 16 for gripping by the caregiver 18. Each of the second pads 38 is comprised of a resiliently compressible material to enhance comfort for the caregiver 18 and each of the second pads 38 is positioned on a respective one of the front surface 24 and the back surface 26 of the belt 12. Additionally, each of the second pads 38 has an opening 40 extending therethrough and the opening 40 in each of the second pads 38 is aligned with the respective gripping hole 16.

In use, the belt 12 is slid behind or beneath the non-ambulatory person 14 when the caregiver 18 needs to lift or reposition the non-ambulatory person 14. The belt 12 is wrapped around the non-ambulatory person 14 such that each of the first end 20 and the second end 22 of the belt 12 are directed toward the caregiver 18. The caregiver 18 grips each of the gripping holes 16 in the belt 12 to lift or reposition the non-ambulatory person 14. In this way the caregiver 18 can move the non-ambulatory person 14 without risk of suffering a lower back injury, or other injury common to lifting heavy objects.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lifting belt assembly for slipping behind a non-ambulatory person thereby facilitating a caregiver to lift or reposition the non-ambulatory person, said assembly comprising:

a belt being slidable behind or beneath a non-ambulatory person that needs to be moved or repositioned, said belt being comprised of a friction inhibiting material wherein said belt is configured to enhance sliding said belt behind or beneath the non-ambulatory person, said belt having a pair of gripping holes each extending therethrough wherein each of said gripping holes is configured to facilitate a caregiver to grip said belt for lifting or repositioning the non-ambulatory person, said belt being elongated between a first end and a second end, said first end being rounded defining a convexly arcuate first end edge having an apex positioned on a longitudinal central axis of said belt, said second end being rounded defining a convexly arcuate second end edge having an apex positioned on a longitudinal central axis of said belt;

a set of first pads, each of said first pads being coupled to said belt, each of said first pads being aligned with a respective one of said gripping holes wherein each of said first pads is configured to be gripped by the caregiver, each of said first pads being comprised of a resiliently compressible material wherein each of said first pads is configured to enhance comfort for the caregiver, said first pads having a curved edge being aligned and coextensive with said convexly arcuate first end edge; and a set of second pads, each of said second pads being coupled to said belt, each of said second pads being aligned with a respective one of said gripping holes wherein each of said second pads is configured to be gripped by the caregiver, each of said second pads being comprised of a resiliently compressible material wherein each of said second pads is configured to enhance comfort for the caregiver, said second pads having a curved edge being aligned and coextensive with said convexly arcuate second end edge.

2. The assembly according to claim 1, wherein said belt has a front surface and a back surface, each of said gripping holes extending through said front surface and said back surface, each of said gripping holes being positioned adjacent to a respective one of said first end or said second end.

3. The assembly according to claim 2, wherein each of said gripping holes has a bounding edge, said bounding edge of each of said gripping holes having a first side and a second side being convexly arcuate with respect to said first side, said second side of said bounding edge of each of said gripping holes being oriented to be co-arcuate with said respective first end or second end of said belt.

4. The assembly according to claim 2, wherein each of said first pads is positioned on a respective one of said front surface and said back surface of said belt, each of said first pads having an opening extending therethrough, said opening in each of said first pads being aligned with said respective gripping hole.

5. The assembly according to claim 2, Wherein each of said second pads is positioned on a respective one of said front surface and said back surface of said belt, each of said second pads having an opening extending therethrough, said opening in each of said second pads being aligned with said respective gripping hole.

6. A lifting belt assembly for slipping behind a non-ambulatory person thereby facilitating a caregiver to lift or reposition the non-ambulatory person, said assembly comprising:

a belt being slidable behind or beneath a non-ambulatory person that needs to be moved or repositioned, said belt being comprised of a friction inhibiting material wherein said belt is configured to enhance sliding said belt behind or beneath the non-ambulatory person, said belt having a pair of gripping holes each extending therethrough wherein each of said gripping holes is configured to facilitate a caregiver to grip said belt for lifting or repositioning the non-ambulatory person, said belt having a first end, a second end, a front surface and a back surface, said belt being elongated between said first end and said second end, said first end being rounded defining a convexly arcuate first end edge having an apex positioned on a longitudinal central axis of said belt, said second end being rounded defining a convexly arcuate second end edge having an apex positioned on a longitudinal central axis of said belt, each of said gripping holes extending through said front surface and said back surface, each of said gripping holes being positioned adjacent to a respective one of said first end or said second end, each of said gripping holes having a bounding edge, said bounding edge of each of said gripping holes having a first side and a second side being convexly arcuate with respect to said first side, said second side of said bounding edge of each of said gripping holes being oriented to be co-arcuate with said respective first end or second end of said belt;

a set of first pads, each of said first pads being coupled to said belt, each of said first pads being aligned with a respective one of said gripping holes wherein each of said first pads is configured to be gripped by the caregiver, each of said first pads being comprised of a resiliently compressible material wherein each of said first pads is configured to enhance comfort for the caregiver, each of said first pads being positioned on a respective one of said front surface and said back surface of said belt, each of said first pads having an opening extending therethrough, said opening in each of said first pads being aligned with said respective gripping hole, said first pads having a curved edge being aligned and coextensive with said convexly arcuate first end edge; and a set of second pads, each of said second pads being coupled to said belt, each of said second pads being aligned with a respective one of said gripping holes wherein each of said second pads is configured to be gripped by the caregiver, each of said second pads being comprised of a resiliently compressible material wherein each of said second pads is configured to enhance comfort for the caregiver, each of said second pads being positioned on a respective one of said front surface and said back surface of said belt, each of said second pads having an opening extending therethrough, said opening in each of said second pads being aligned with said respective gripping hole, said second pads having a curved edge being aligned and coextensive with said convexly arcuate second end edge.

* * * * *